US010568420B1

(12) United States Patent
Lord

(10) Patent No.: US 10,568,420 B1
(45) Date of Patent: Feb. 25, 2020

(54) GAME TABLE

(71) Applicant: Scott D. Lord, Geneva, NY (US)

(72) Inventor: Scott D. Lord, Geneva, NY (US)

( * ) Notice: Subject to any disclaimer, the term of this patent is extended or adjusted under 35 U.S.C. 154(b) by 0 days.

(21) Appl. No.: 16/238,185

(22) Filed: Jan. 2, 2019

Related U.S. Application Data

(60) Provisional application No. 62/713,038, filed on Aug. 1, 2018.

(51) Int. Cl.

| | |
|---|---|
| ***A47B 25/00*** | (2006.01) |
| ***A47B 13/08*** | (2006.01) |
| ***A47B 83/04*** | (2006.01) |
| ***A47B 13/16*** | (2006.01) |

(52) U.S. Cl.
CPC ..... *A47B 25/00* (2013.01); *A47B 13/081* (2013.01); *A47B 13/088* (2013.01); *A47B 13/16* (2013.01); *A47B 83/045* (2013.01)

(58) Field of Classification Search
CPC ..... A47B 25/00; A47B 13/081; A47B 13/088; A47B 13/16; A47B 83/045
See application file for complete search history.

(56) References Cited

U.S. PATENT DOCUMENTS 2,003,835 A * 6/1935 Mitchell ..... A47B 3/0815 16/348
2,102,449 A * 12/1937 Zimmerman ..... A47B 25/00 108/63
2012/0079967 A1 4/2012 Palese
2016/0324309 A1* 11/2016 Kassanoff ..... A47B 13/081
2017/0099962 A1 4/2017 Ireland et al.
2017/0156489 A1 6/2017 Tippmann
2017/0172291 A1 6/2017 Leverett
2017/0360188 A1 12/2017 Alguire
2017/0367475 A1 12/2017 Carrera Gonzalez

FOREIGN PATENT DOCUMENTS

| | | |
|---|---|---|
| FR | 2934133 A | 1/2010 |
| GB | 489491 A | 7/1938 |
| GB | 678691 A | 9/1952 |
| JP | H0621429 U | 3/1994 |
| KR | 101422622 B1 | 7/2014 |

OTHER PUBLICATIONS

Puzzle Coffee Table Build Plans, Designed Decor, Apr. 22, 2018, Website available at: https://designeddecor.com/puzzle-coffee-table-build-plans/.

* cited by examiner

*Primary Examiner* — Jeffrey S Vanderveen
(74) *Attorney, Agent, or Firm* — Bond, Schoeneck & King, PLLC

(57) ABSTRACT

The present invention generally encompasses a game table including a base, a first layer fixedly secured to the base, a second layer arranged to at least partially encompass and slidingly engage with the first layer, and a third layer arranged to at least partially encompass and pivotably engage with the second layer. The first layer is operatively arranged to display a first plurality of assembled game pieces, the second layer is operatively arranged to display a second plurality of unassembled game pieces, and the third layer is operatively arranged to cover and protect the first and second layers.

17 Claims, 11 Drawing Sheets

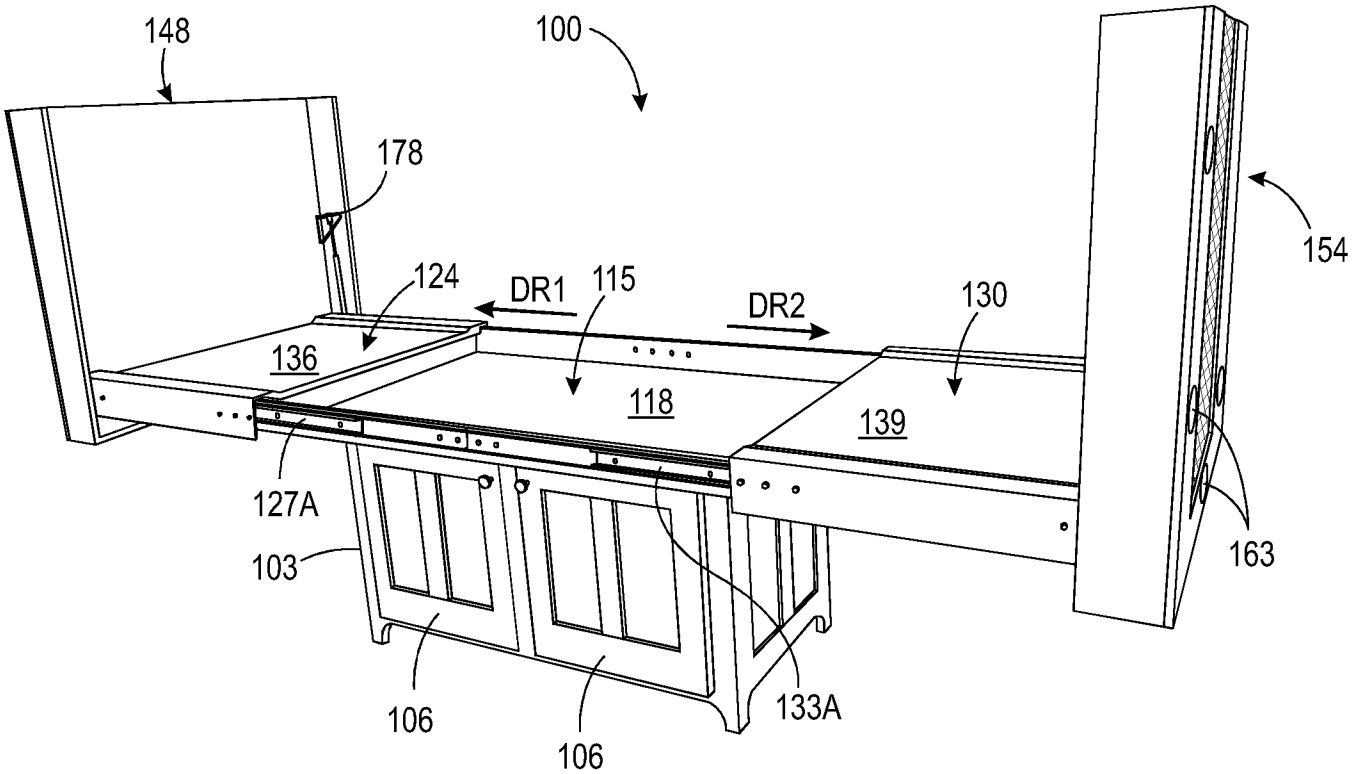
FIG. 4
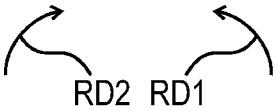

GAME TABLE

CROSS REFERENCE TO RELATED APPLICATIONS

This Application claims priority to U.S. Provisional Patent Application Ser. No. 62/713,038, filed on Aug. 1, 2018, entitled "GAME TABLE", which application is incorporated herein in its entirety.

FIELD OF THE DISCLOSURE

The disclosure relates to game tables, more specifically, to expandable/telescopingly engaging/nested surfaces for game tables adapted to organize game pieces.

BACKGROUND

When assembling a puzzle, or playing a table-top, e.g., a board game, most users arrange, possibly, hundreds of game pieces on the surface of a single table. If the user is, e.g., assembling a puzzle, the usual approach begins with flipping each puzzle piece over so that the side having printed matter attached thereto is visible to the user. After all of the unassembled puzzle pieces are flipped over, the user begins searching for individual pieces that fit together and as time progresses, more and more of the image displayed on the printed matter becomes visible. Typically, the pieces that fit together are assembled on the same table surface as the unassembled pieces. This arrangement takes up an undesirable amount of space.

Additionally, some games and most puzzles are not completed or assembled in a single sitting. If the user wishes to reclaim some or all of the space consumed by the assembled and unassembled pieces, the user is forced to, e.g., disassemble the portions of the game or puzzle that have been completed and start anew at a later date. Furthermore, if assembling a puzzle, even if only the unassembled pieces of a puzzle were to be removed, the likelihood that each piece would remain in position during removal, i.e., with the printed matter facing the user, is extremely low.

Thus, there is a long-felt need for a game table capable of nesting multiple table surfaces such that unassembled game pieces and assembled game pieces can remain undisturbed, whilst maintaining the typical benefits of a table. This obviates the need to remove/disturb a game or puzzle while in progress, or in progress of assembly.

SUMMARY OF THE DISCLOSURE

Broadly, the invention includes a game table having multiple displaceable surfaces arranged to aid in the construction and display of a game or puzzle while simultaneously retaining the functionality of a table. The table broadly comprises a base and a top portion having nested three layers. The base is intended to be a cabinet having multiple access doors and storage space, and can be arranged to accept and store game materials, e.g., playing cards, poker chips, puzzles, various table surface mats, board games, etc. The first layer, i.e., the layer closest to the base, is arranged to display a complete or semi-complete game/puzzle. The second layer is bifurcated and has two components, a first section and a second section. The first and second sections are arranged to at least partially encompass and slidingly engage with the first layer via a plurality of drawer slides. The third layer is also bifurcated into third and fourth sections. The third and fourth sections are arranged to at least partially encompass and pivotably engaged with the first and second sections of the second layer via a first and second hinge, respectively. Additionally, gas shock mechanisms are provided between the second layer and the third layer as a means to aid in the pivoting motion of the third layer as well as provide a stop to prevent over-rotation of the third layer with respect to the second layer.

Accordingly, there is provided a game table including a base and a top portion. The top portion including a first layer fixedly secured to the base, a second layer arranged to at least partially encompass the first layer, and a third layer arranged to at least partially encompass and pivotably engage with the second layer. The first layer is operatively arranged to display a first plurality of assembled game pieces, the second layer is operatively arranged to display a first plurality of unassembled game pieces, and the third layer is operatively arranged to cover and protect the first and second layers.

In an example, the second layer comprising a first section and a second section.

In an example, the first section and the second section of the second layers are slidingly engaged with the first layer.

In an example, the third layer comprises a third section and a fourth section.

In an example, the third section and the fourth section of the third layer are pivotably secured to the second layer.

In an example, the third section of the third layer is pivotably secured to the first section of the second layer via a first hinge.

In an example, the fourth section of the third layer is pivotably secured to the second section of the second layer via a second hinge.

In an example, the top portion further includes a first rotational stop arranged between the first section of the second layer and the third section of the third layer, wherein the first rotational stop is arranged to prevent the third section from pivoting more than 90 degrees about the first hinge with respect to a surface of the second layer.

In an example, top portion further includes a second rotational stop arranged between the second section of the second layer and the fourth section of the third layer, wherein the second rotational stop is arranged to prevent the third section from pivoting more than 90 degrees about the second hinge with respect to a surface of the second layer.

In an example, the second layer further comprises a lip arranged about at least a portion of a perimeter of the second layer.

In an example, the third layer further comprises a border arranged substantially about a perimeter of the third layer.

In an example, a game table is provided, the game table including a base and a top portion. The top portion includes a first layer fixedly secured to the base, a second layer, and a third layer. The second layer includes a first section and a second section, the first section and the second section arranged to at least partially encompass the first layer. The third layer includes a third section arranged to at least partially encompass the first section of the second layer and pivotably engage with the first section of the second layer and a fourth section arranged to at least partially encompass the second section of the second layer and pivotably engage with the second section of the second layer. The first layer is operatively arranged to display a first plurality of assembled game pieces, the second layer is operatively arranged to display a first plurality of unassembled game pieces, and the third layer is operatively arranged to cover and protect the first and second layers.

In an example, the third section of the third layer is pivotably secured to the first section of the second layer via a first hinge.

In an example, the fourth section of the third layer is pivotably secured to the second section of the second layer via a second hinge.

In an example, the top portion further includes a first rotational stop arranged between the first section of the second layer and the third section of the third layer, wherein the first rotational stop is arranged to prevent the third section from pivoting more than 90 degrees about the first hinge with respect to the second layer.

In an example, the top portion further includes a second rotational stop arranged between the second section of the second layer and the fourth section of the third layer, wherein the second rotational stop is arranged to prevent the third section from pivoting more than 90 degrees about the second hinge with respect to the second layer.

In an example, the second layer further includes a lip arranged about at least a portion of a perimeter of the second layer.

In an example, the third layer further includes a border arranged substantially about a perimeter of the third layer.

These and other aspects of the various embodiments will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various embodiments.

FIG. 4 is a side perspective view of a game table according to the present disclosure in a fully expanded state.

DETAILED DESCRIPTION OF EMBODIMENTS

Figure 1:
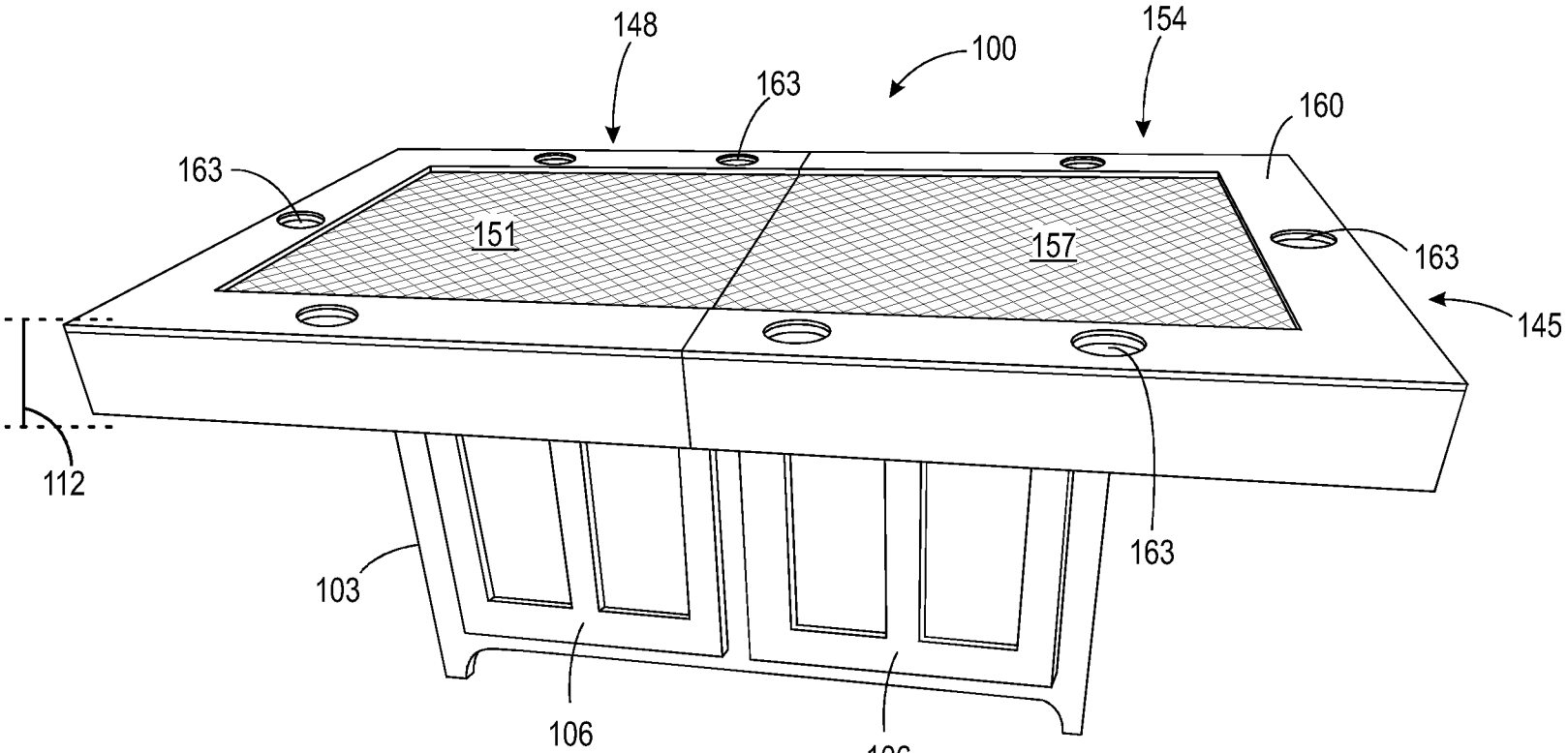
FIG. 1 is a side perspective view of a game table according to the present disclosure in a collapsed state.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics. It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

Moreover, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Broadly, the invention comprises a game table having multiple displaceable surfaces arranged to aid in the construction and display of a game or puzzle while simultaneously retaining the functionality of a table. The table broadly comprises a base and a top portion with three layers. The base is intended to be a cabinet having multiple access doors to storage space and can be arranged to accept and store game materials, e.g., playing cards, poker chips, puzzles, various table surface mats, etc. The first layer, i.e., the layer closest to the base, is arranged to display a complete or semi-complete puzzle or game. The second layer is bifurcated and has two components, a first section and a second section. The first and second sections are arranged to at least partially encompass and slidingly engage with the first layer via a plurality of drawer slides. The third layer is also bifurcated into third and fourth sections. The third and fourth sections are arranged to at least partially encompass and pivotably engaged with the first and second sections of the second layer via a first and a second hinge, respectively. Additionally, gas shock mechanisms are provided between the second layer and the third layer as a means to aid in the pivoting motion of the third layer as well as provide a stop to prevent over-rotation of the third layer with respect to the second layer.

Figure 2:
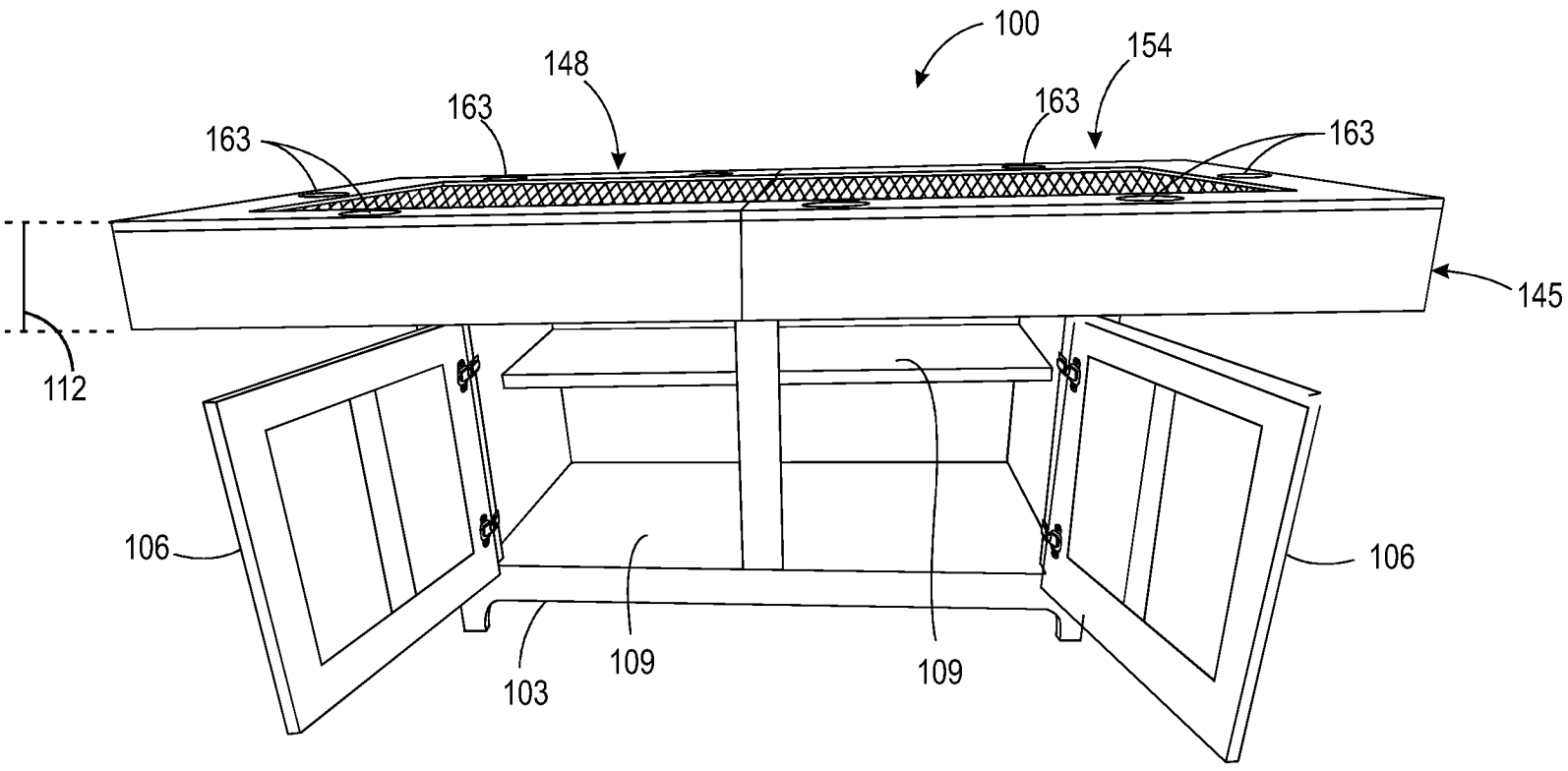
FIG. 2 is a side perspective view of a game table according to the present disclosure in a collapsed state.
Figure 3:
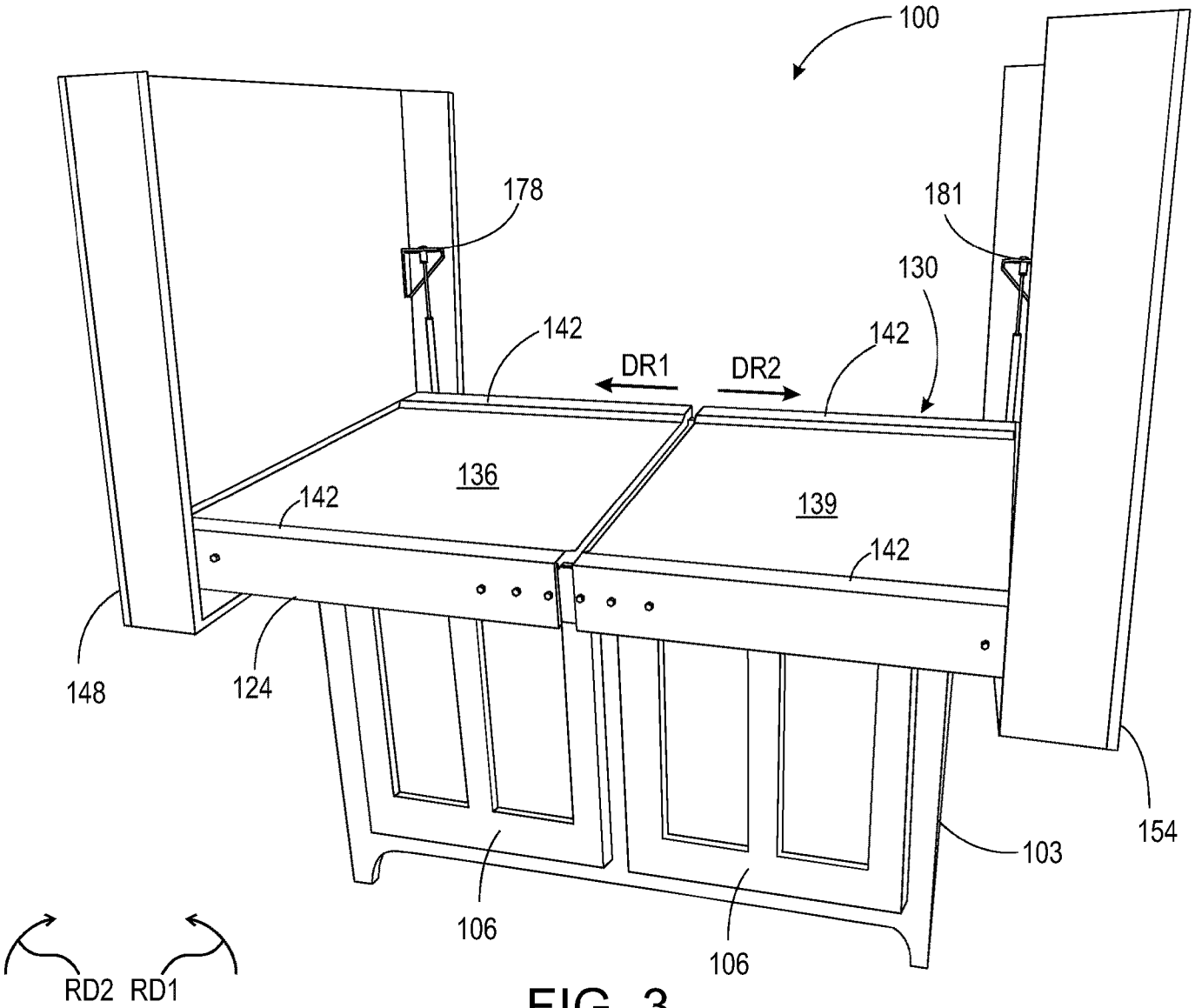
FIG. 3 is a side perspective view of a game table according to the present disclosure in a partially expanded state.

The following description should be read in view of FIGS. 1-4. FIGS. 1 and 2 illustrate game table 100 in a collapsed state. FIGS. 3 and 4 illustrate game table 100 in a partially expanded state and a fully expanded state respectively. Game table 100 includes base 103 and top portion 112. Base 103 is arranged beneath top portion 112 of game table 100. As illustrated in FIG. 2, base 103 of game table 100 is fixedly secured to at least first layer 115 (shown in FIG. 4) and is operatively arranged to support and elevate table top portion 112 into a usable position. Base 103 is substantially cuboid, taking the form of a rectangular cabinet. In one example, base 103 has six sides which are supported by a plurality of feet which remain in contact with the floor on which the game table 100 sits. Base 103 is substantially hollow and contains at least one shelf 109 operatively arranged to hold and/or store various items that can be used in connection with game table 100 such as, but not limited to: cards, poker chips, puzzles, board games, table clothes, place mats, dishware, additional interchangeable table surface mats, etc. Base 103 can include at least one door 106 or at least one drawer arranged to access the substantially hollow space in the center of base 103. It should be appreciated that base 103 can take any form that would adequately support top portion 112 of the game table 100, e.g., a circular table base, a square table base, a set of legs independently secured (pivotably, telescopingly, or otherwise) to the top portion 112.

As illustrated in FIGS. 3 and 4, top portion 112 of game table 100 includes first layer 115, second layer 121, and third layer 145. First layer 115 is fixedly secured to base 103 and is intended to be the lowermost layer, i.e., the layer closest to the ground on which base 103 sits. First layer 115 has a first surface, i.e., first surface 118. First surface 118 is intended to be made from a single piece of material, i.e., not bifurcated into separate sections like second layer 121 and third layer 145, discussed below. First surface 118 is arranged to receive and display a first plurality of assembled game pieces (not shown) or a first plurality of partially assembled game pieces (not shown). In one example, the game pieces are puzzle pieces. In other words first surface 118 of first layer 115 is intended to be the surface upon which a user assembles a puzzle and displays said puzzle when finished or in the process of assembly. First layer 115 can include a set of four walls arranged to create a perimeter around first surface 118 and prevent any game pieces displayed thereon from leaving first surface 118. Additionally, the set of four walls creates a space above first surface 118 such that any assembled pieces of the first plurality of assembled game pieces remains undisturbed during any transition between the closed state, partially expanded state, and fully expanded states as will be discussed in more detail below.

Second layer 121 includes first section 124 and second section 130. First section 124 is slidingly engaged with first layer 115 via a first pair of slides, i.e., first slide 127A and third slide 127B (not shown). First section 124 is arranged to slide or translate in a first direction DR1 with respect to first layer 115. Second section 130 is also slidingly engaged with first layer 115 via a second pair of slides, i.e., second slide 133A and fourth slide 133B (shown in FIGS. 10 and 13). Second section 130 is arranged to slide or translate in a second direction DR2, opposite DR1 with respect to first layer 115. In one example, first slide 127A, second slide 133A, third slide 127B (not shown) and fourth slide 133B (shown in FIGS. 10 and 13) are intended to be side-mounted drawer slides; however, it should be appreciated that first slide 127A, second slide 133A, third slide 127B (not shown) and fourth slide 133B (shown in FIGS. 10 and 13) can be any apparatus arranged to allow translation of first section 124 in first direction DR1 and second section 130 in second direction DR2. First section 124 and second section 130 further include first section surface 136 and second section surface 139, respectively. First section surface 136 and second section surface 139 are intended to receive and display a plurality of unassembled game pieces (not shown), e.g., puzzle pieces that have not been paired with a partially completed puzzle on first surface 118 of first layer 115. When game table 100 is in its partially expanded state, as shown in FIG. 2, game table 100 is arranged such that first section surface 136 of first section 124 and second section surface 139 of second section 130 form one larger surface which can have a perimeter. On at least one side of this perimeter, second layer 121 can include a lip, i.e., lip 142 arranged to prevent any unassembled game pieces, e.g., puzzle pieces, of the plurality of unassembled game pieces (not shown) from sliding off or being accidentally knocked off and removed from the respective surfaces of the first and second sections. First section 124 and second section 130 of second layer 121 are configured such that they at least partially encompass or surround first layer 115 and protect the plurality of assembled game pieces (not shown) displayed thereon from being disturbed. The configuration of first section 124 and second section 130 can take the form of a substantially hollow box shape having the bottom of the box and at least one side wall removed such that they can surround at least a portion of first layer 115 on three sides. In other words, first section 124 and second section 130 are arranged to at least partially encompass, e.g., surround on at least three sides, first layer 115. This allows for the nesting of first surface 118 of first layer 115 within and under the respective surfaces of second layer 121 as well as provides an aesthetically pleasing border such that first surface 118, first slide 127A, second slide 133A, third slide 127B (not shown) and fourth slide 133B (shown in FIGS. 10 and 13) cannot be seen in the partially expanded state shown in FIG. 3.

As illustrated in FIGS. 1 and 2, third layer 145, is bifurcated into third section 148 and fourth section 154. Third section 148 includes third section surface 151 and fourth section 154 includes fourth section surface 157. The overall surface of third layer 145 includes an interchangeable mat surface, i.e., third section surface 151 and fourth section surface 157 combine to form one surface which is interchangeable. The interchangeable mat surface can be made of any material sufficient for use on a table surface including but not limited to: rubber, felt, wood, melamine, Medium Density Fiberboard (MDF), High Density Fiberboard (HDF), Plywood, Polyethylene or other plastic material, carbon fiber, etc. Third layer 145 may further include a border 160, i.e., a material arranged to span the outer boundary or perimeter of the table surface and at least partially overlap third section surface 151 and fourth section surface 157 of third layer 145. Border 160 may include a plurality of cutouts 163 operatively arranged to engage with a cup, glass, or other beverage. In one example, border 160 can be made of rubber, melamine, Medium Density Fiberboard (MDF), High Density Fiberboard (HDF), Plywood, Polyethylene or other plastic material, carbon fiber, etc. Third layer 145 is split into third section 148 and fourth section 154 such that, upon expansion, each section of third layer 145 will slide and/or pivot out of the way of first layer 115 and/or second layer 121.

Figure 5A:
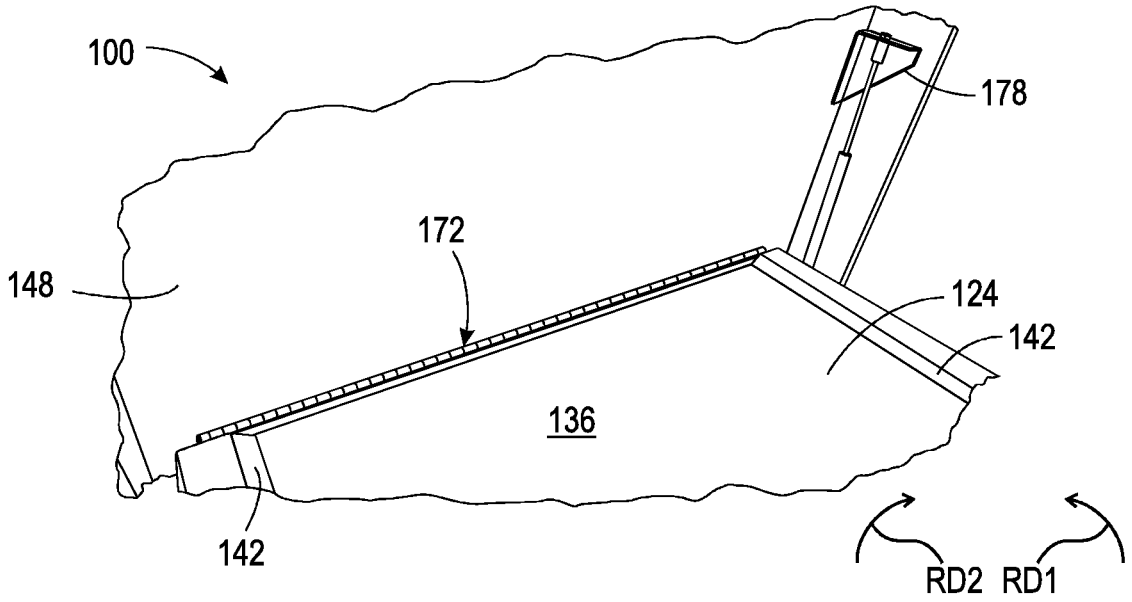
FIG. 5A is an enlarged view a portion of a game table according to the present disclosure.
Figure 5B:
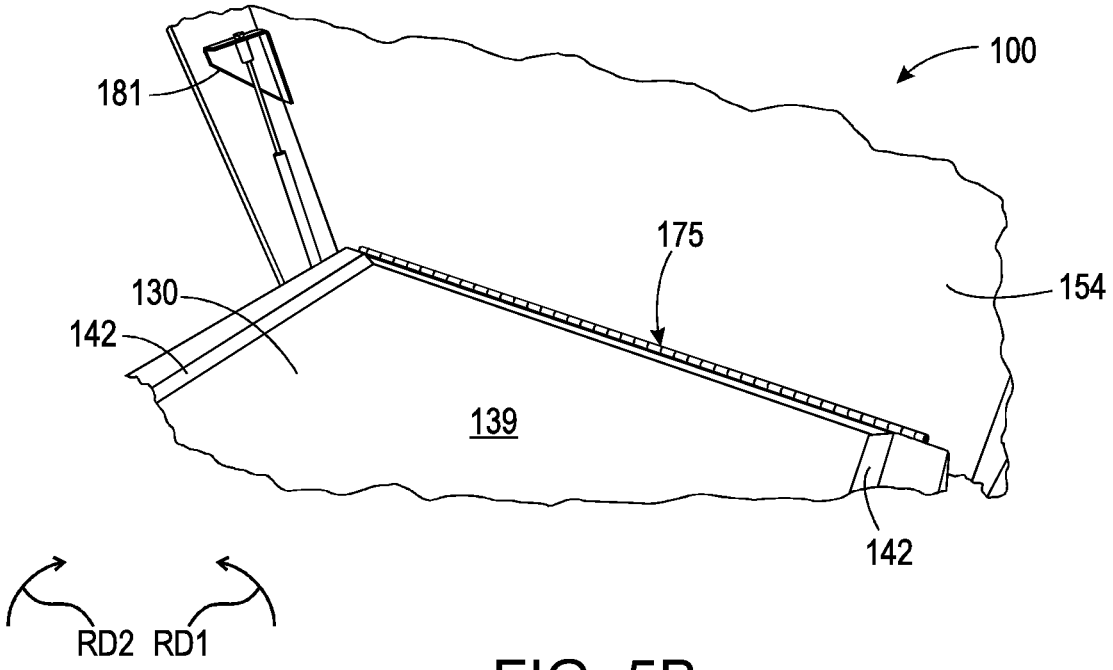
FIG. 5B is an enlarged view a portion of a game table according to the present disclosure.

The following description should be read in view of FIGS. 1-15. Game table 100 includes a first hinge 172 arranged at a distal end of first section 124 of second layer 121, i.e., the end farthest from base 103; and, a second hinge 175 is arranged at a distal end of second section 130 of second layer 121, i.e., the end farthest from base 103. FIG. 5A illustrates the hinged connection, via first hinge 172, between first section 124 of second layer 121 and third section 148 of third layer 145 of game table 100. FIG. 5B illustrates a hinged connection, via second hinge 175, between second section 130 of second layer 121 and fourth section 154 of third layer 145 of game table 100. In one example, first hinge 172 is arranged on the corner or edge of first section surface 136 of first section 124, and second hinge 175 is arranged on the corner or edge of second section surface 139 of second section 130. Moreover, first hinge 172 and second hinge 175 are also arranged to engage a lower surface of third section 148 and fourth section 154, respectively. This lower surface is intended to be the underside or reverse side of third section surface 151 and fourth section surface 157 of third layer 145, respectively. Additionally, in one example, these hinges are not secured on the edges or corners of the respective sections of the third layer, they are shifted away from the distal ends of each respective section towards base 103. This arrangement is illustrated in FIG. 3 and creates a pivot point on each lower surface such that when third section 148 is pivoted or rotated about first hinge 172 the distal end of third section 148 acts as a rotational stopping mechanism to prevent over rotation of third section 148 with respect to first section 124. A similar arrangement is present between second section 130 and fourth section 154.

Although not illustrated it should be appreciated that one or more light sources or luminaires may be provided and/or attached or otherwise affixed to the bottom surface of third section 148 and/or fourth section 154 such that the unassembled game pieces arranged and/or displayed on first section surface 136 and second section surface 139 are illuminated. Moreover, an additional one or more light sources or luminaires may be provided and/or attached or otherwise affixed to the bottom surface of first section 124 and/or second section 130 such that the assembled or partially assembled game pieces arranged and/or displayed on first surface 118 are illuminated. These light sources or luminaries are intended to be Light Emitting Diode (LED) arrays; however, it should be appreciated that any light source or luminaire sufficient to provided adequate lighting to the game pieces could be utilized. Furthermore, it should further be appreciated that, although not illustrated, a plurality of charging ports may be provided on the outside vertical surfaces of third section 148 and fourth section 154, i.e., on the wall-like boundaries that enable third section 148 and fourth section 154 to at least partially encompass first section 124 and second section 130, respectively. These charging ports can take any form known in the art, for example, USB-A, USB-B, USB-C, Micro-USB A, Micro-USB B, USB Mini-b(4 pin or 5 pin), USB 3.0 A-type, USB 3.0 Micro B, or any standard 120V AC power outlet/socket. These charging ports electrically connected to at least one power supply, which for example could be a mains power supply (not shown).

In one example, as can be seen in FIGS. 5A and 5B, to prevent the respective sections of third layer 145 from over-rotating about either first hinge 172 or second hinge 175, rotational stops are provided, i.e., first rotational stop 178 and second rotational stop 181. First rotational stop 178 is fixedly secured between the outside of first section 124 of second layer 121 and the inside of third section 148 of third layer 145. First rotational stop 178 is arranged to prevent over-rotation, e.g., rotation of third section 148 more than 90 degrees in first rotational direction RD1 with respect to first section 124. Similarly, second rotational stop 181 is arranged to prevent over-rotation, e.g., rotation of fourth section 154 more than 90 degrees in second rotational direction RD2 with respect to second section 130. It should be appreciated that first rotational stop 178 and second rotational stop 181 can be arranged to allow for rotation of different magnitudes, e.g., 180 degrees, 270 degrees, or any other rotational magnitude in first rotational direction RD1 or second rotation direction RD2 sufficient to pivot or rotate the respective sections of third layer 145 out of the way of the respective sections of second layer 121. In one example, third section 148 and fourth section 154 are allowed to rotate 270 degrees in first rotational direction RD1 and second direction RD2, respectively, such that the distal ends of the third section 148 and fourth section 154 contact the ground or floor upon which base 103 sits. This arranged allows the third section 148 and the fourth section 154 to act as support structures for first section 124 and second section 130 of second layer 121 when they are extended, i.e., translated about first slide 127 and second slide 133 in first direction DR1 and second direction DR2, respectively. First rotational stop 178 and second rotational stop 181 are intended to be gas-shocks arrangement between the inside surface of third layer 145 and the outer side portion of the second layer 121. In one example, each side of first section 124 of second layer 121 contains a rotational stop, e.g., a gas shock arranged between each outer side of first section 124 and each inner side of third section 148 of the third layer 145. In other words, both sides could utilize two or more gas shocks or rotational stops. These gas-shocks/rotational stops are also intended to aid the user in lifting/pivoting/rotating third section 148 and fourth section 154 about first hinge 172 and second hinge 175, respectively. It should be appreciated that although two shocks per side can be utilized, only one shock is necessary. One example of a shock that could be used is a gas shock having part #4138t51 available through McMaster Carr. It should also be appreciated that a shock is not the only means available to prevent the over rotation of each section of the third layer with respect to the second layer. For example, a simple chain or rope could be substituted in place of the shock. Additionally a physical stop, protrusion, or cavity could be placed on the outer surface of the second layer which corresponds with another physical stop, e.g., a protrusion or cavity on each respective section of the third layer.

Figure 6:
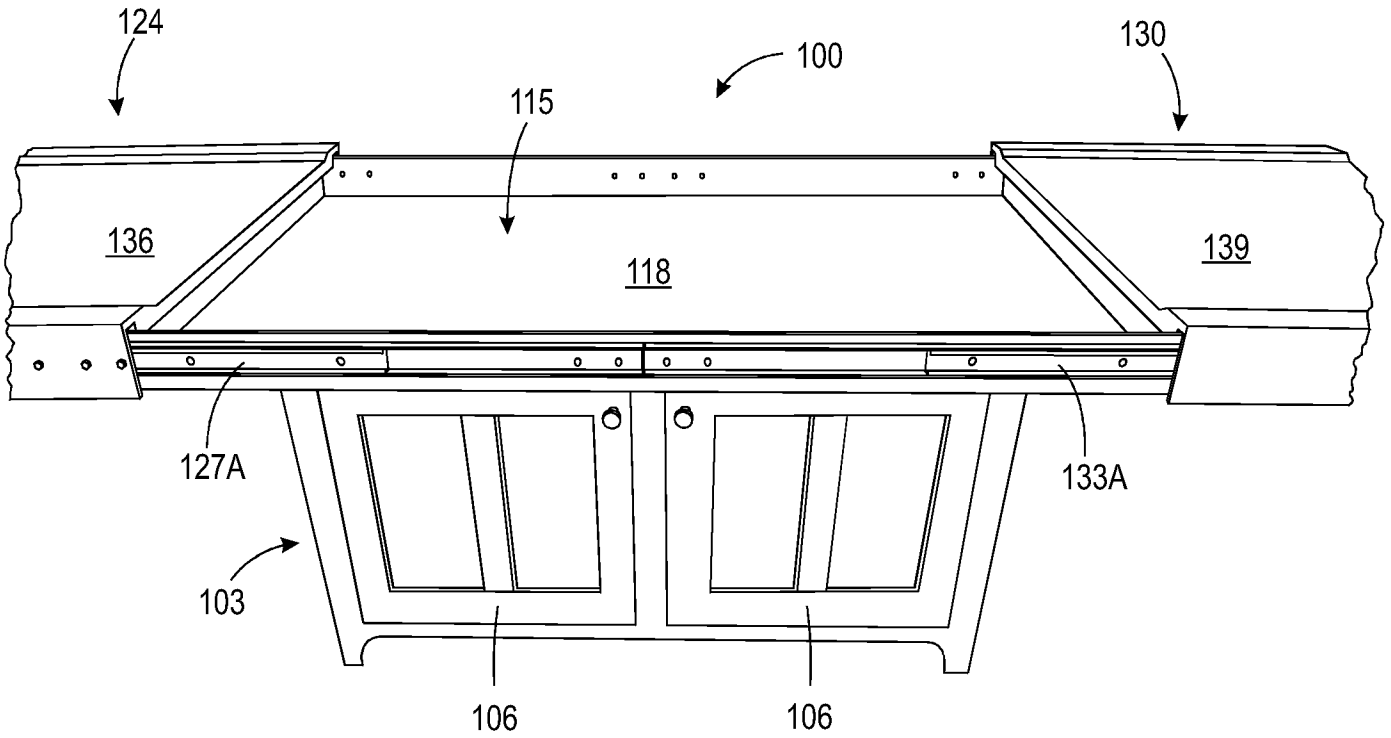
FIG. 6 is an enlarged view of a portion of a game table illustrating a first layer of a top portion of the game table according to the present disclosure.
Figure 7:
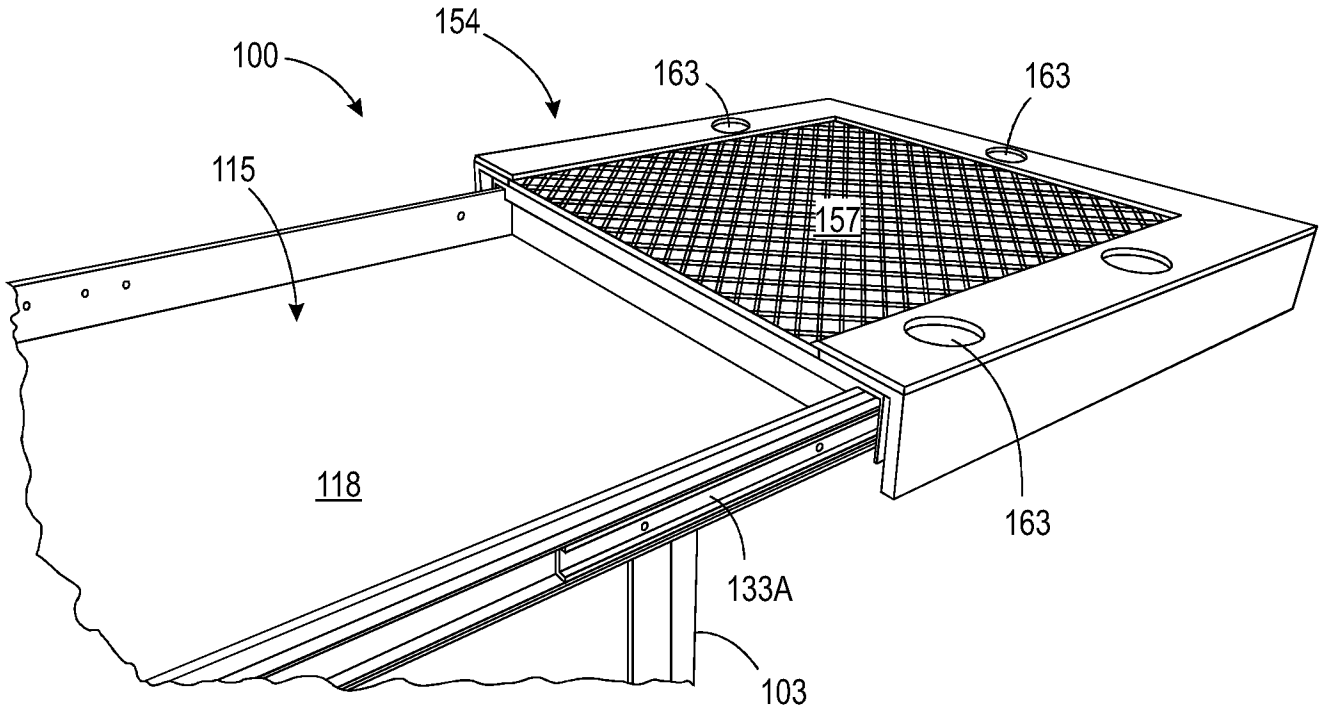
FIG. 7 is an enlarged view of a game table in a low profile fully expanded state according to the present disclosure.

FIG. 6 illustrates a close up perspective view of game table 100 in the fully expanded state. Base 103, first layer 115, and second layer 121 are illustrated having first slide 127A and second slide 133A arranged between first layer 115 and each respective section of second layer 121. FIG. 7 illustrates game table 100 in an alternative fully expanded state, i.e., where third section 148 and fourth section 154 are not in a pivoted position and instead remain non-pivoted or rotated with respect to first section 124 and second section 130, respectively. In other words, third section 148 and fourth section 154 are rotated 0 degrees with respect to first section 124 and second section 130, respectively. In this arrangement, each half or section of the second layer slidably translates laterally with respect to the first layer. Instead of having the third and fourth sections of the third layer pivot 90 degrees with respect to the first and second sections of the second layer, the first and second sections of the third layer can remain in their lower profile collapsed state protecting the unassembled pieces while displaying the partially completed or fully completed game/puzzle. As recited above, it should be appreciated that the sections of third layer 145 do not need to pivot between 0 degrees and 90 degrees with respect to second layer 121 of game table 100 and can pivot to any angle, for example 90 degrees, 180 degrees, 270 degrees, or slightly less than 360 degrees or any angle therebetween.

Figure 8:
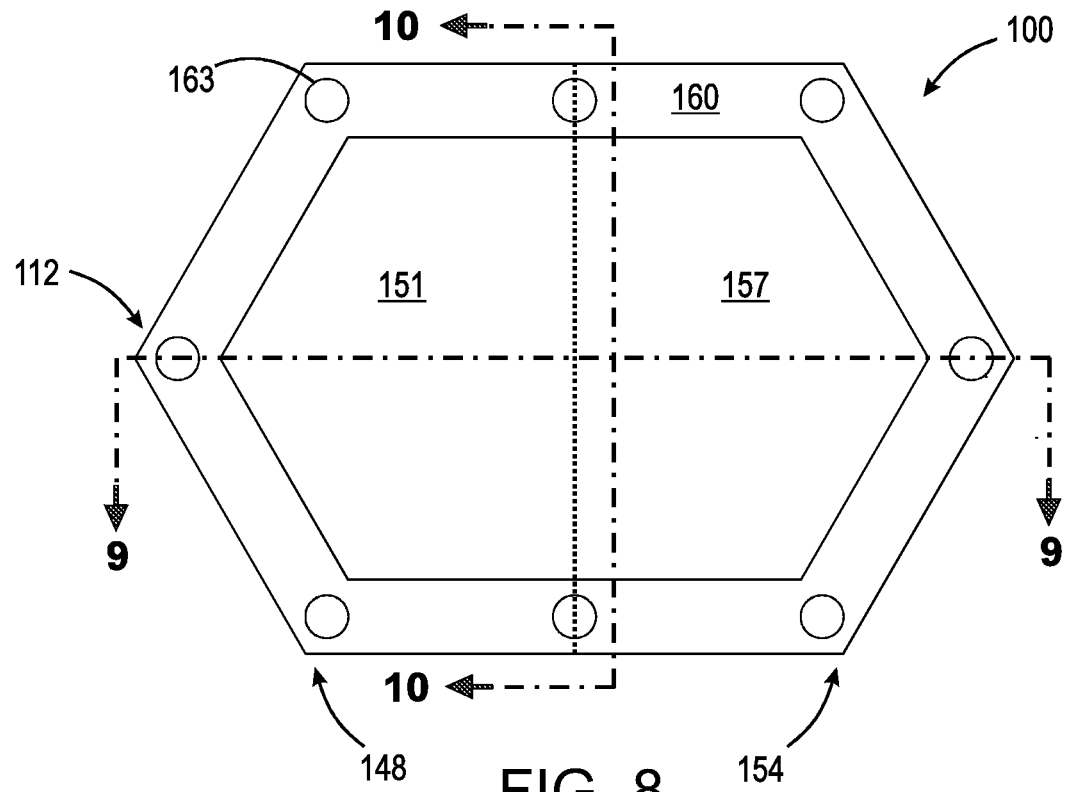
FIG. 8 is a top plan view of one example top portion of a game table according to the present disclosure.
Figure 9:
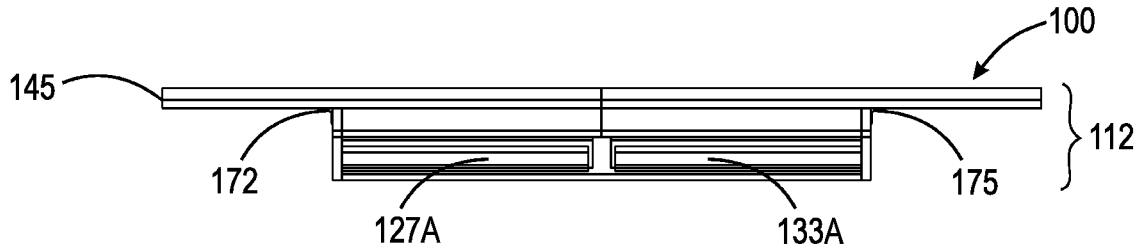
FIG. 9 is a side cross-sectional view of a top portion of a game table according to the present disclosure taken generally along line 9-9 in FIG. 8.
Figure 10:
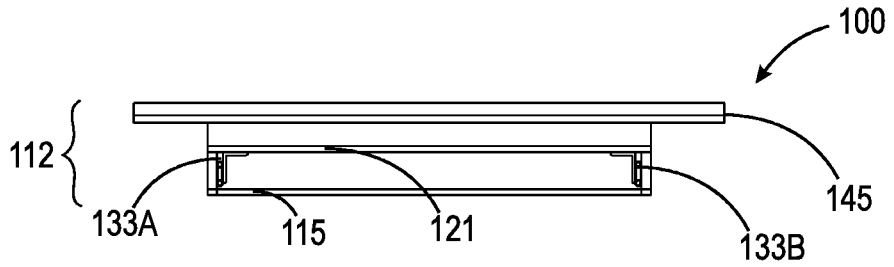
FIG. 10 is a front cross-sectional view of a top portion of a game table as according to the present disclosure taken generally along line 10-10 in FIG. 8.

FIG. 8 is a top plan view of one example of game table 100. It should be appreciated that the overall shape of third layer 145 of game table 100 can take any shape which acts as a functional table surface, e.g., octagonal, hexagonal, square, rectangular, triangular, etc. FIG. 9 illustrates is a side cross sectional view taken substantially down an imaginary longitudinal centerline 9-9 of game table 100 depicted in FIG. 8. FIG. 10 is a front cross sectional view of the top portion 112 of game table 100 taken generally along imaginary axis 10-10 cut through first layer 115, second section 130 of second layer 121, and fourth section 154 of third layer 145 depicted in FIG. 8. It should be noted that in FIG. 9, the cross sectional profiles of the drawers slides and their position on the exterior of the first layer and interior of the second layer are shown.

Figure 11:
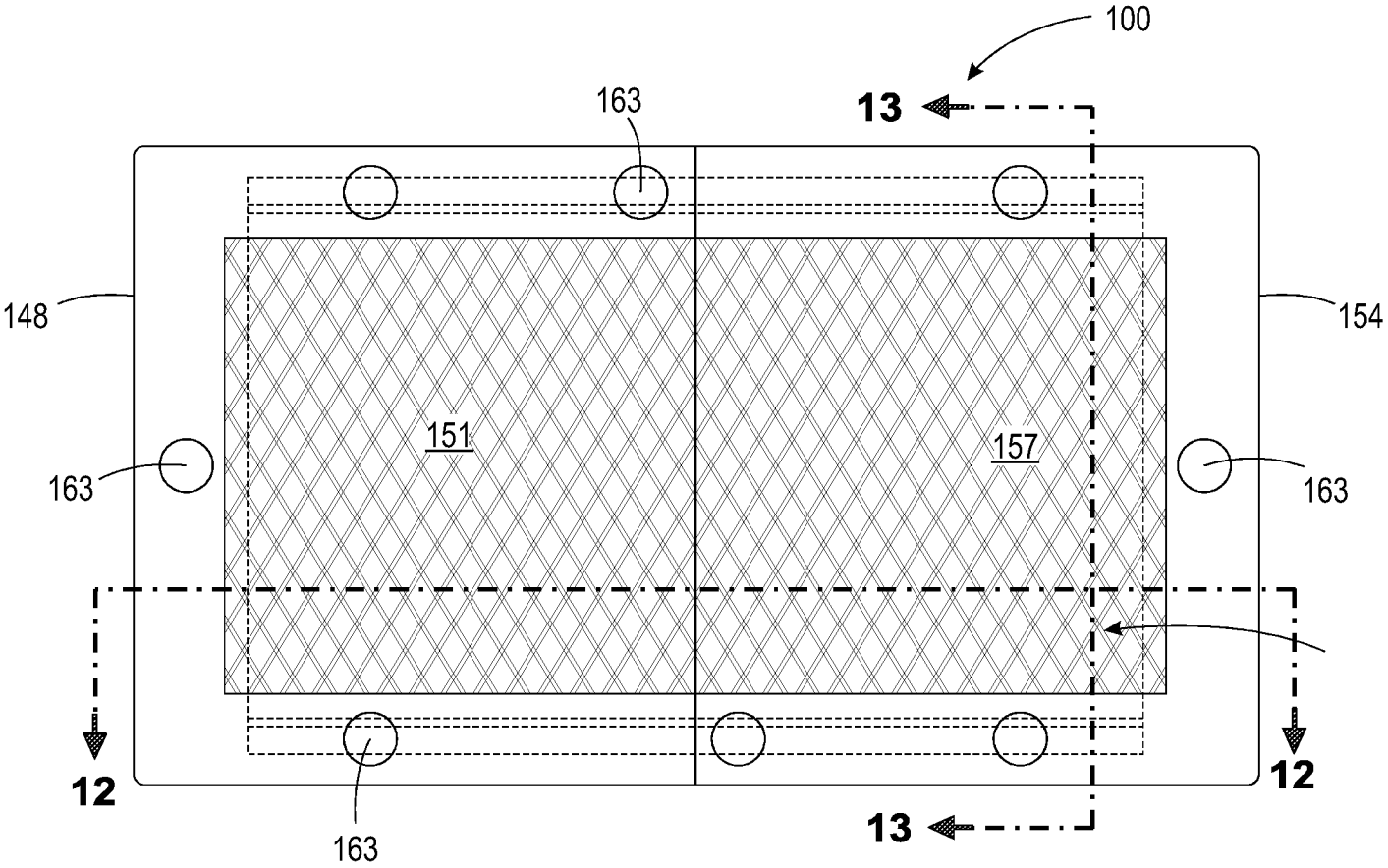
FIG. 11 is a top plan view of one example game table according to the present disclosure.
Figure 12:
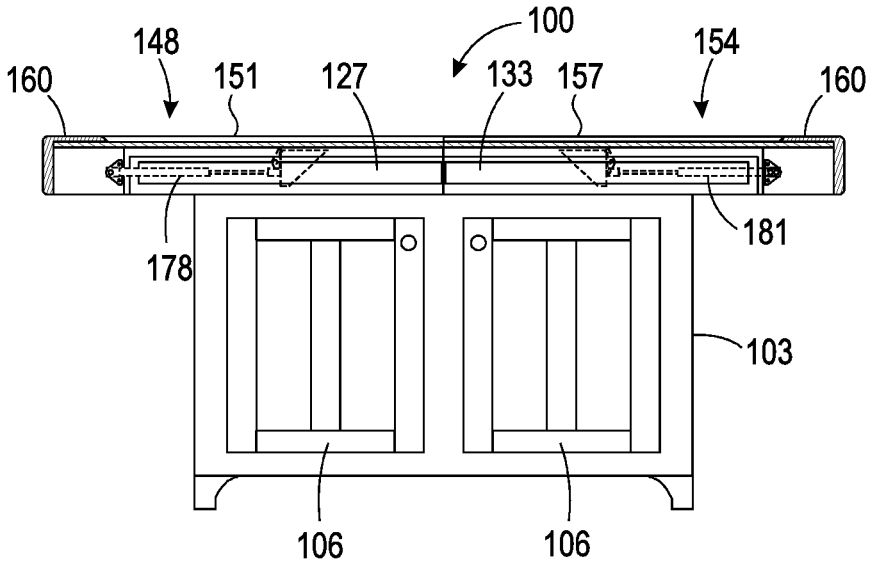
FIG. 12 is a front elevational view with a partial cross sectional view of a top portion of a game table in a collapsed state according to the present disclosure taken generally along line 12-12 in FIG. 11.
Figure 13:
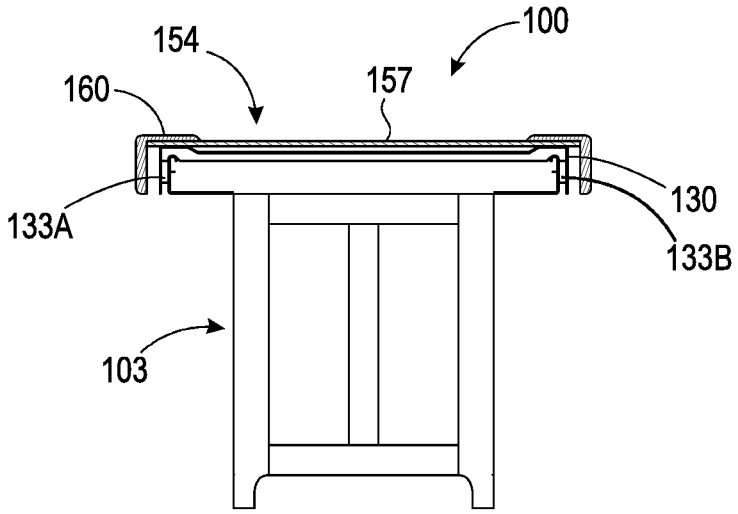
FIG. 13 is a side elevational view and partial cross-sectional view of a top portion of a game table in a collapsed state according to the present disclosure taken generally along line 13-13 in FIG. 11.

FIG. 11 is a top plan view of one example embodiment of the surface of game table 100. FIG. 12 illustrates a side view of game table 100 with a partial cross-sectional view of top portion 112 taken generally along line 12-12 in FIG. 11. FIG. 13 illustrates a front cross-sectional view of game table 100 taken generally along line 13-13 in FIG. 11.

Figure 14:
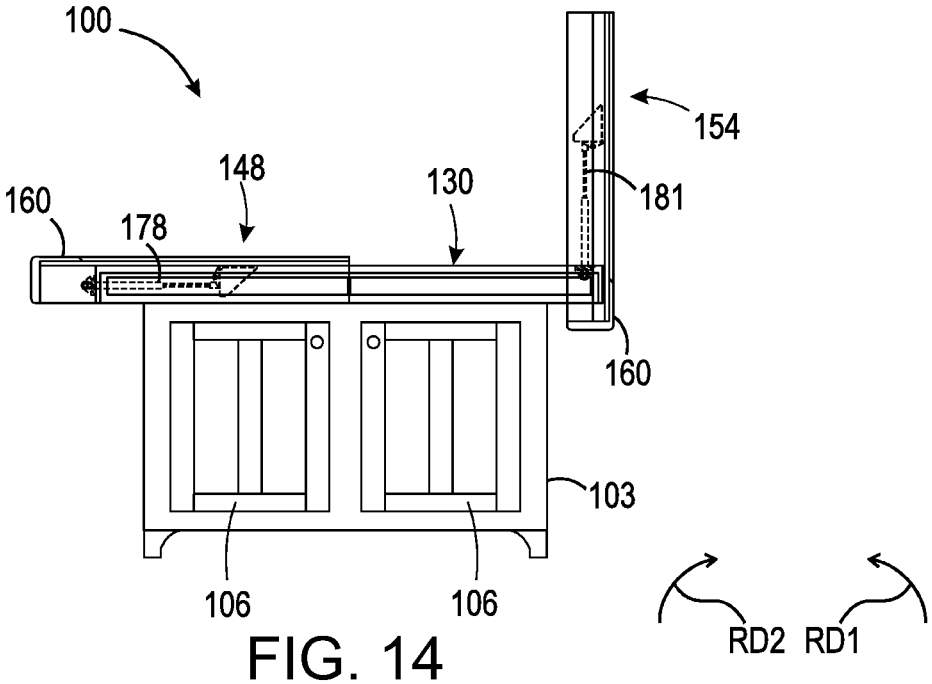
FIG. 14 is a side elevational view of the game table illustrated in FIG. 12 in a half partially expanded state.
Figure 15:
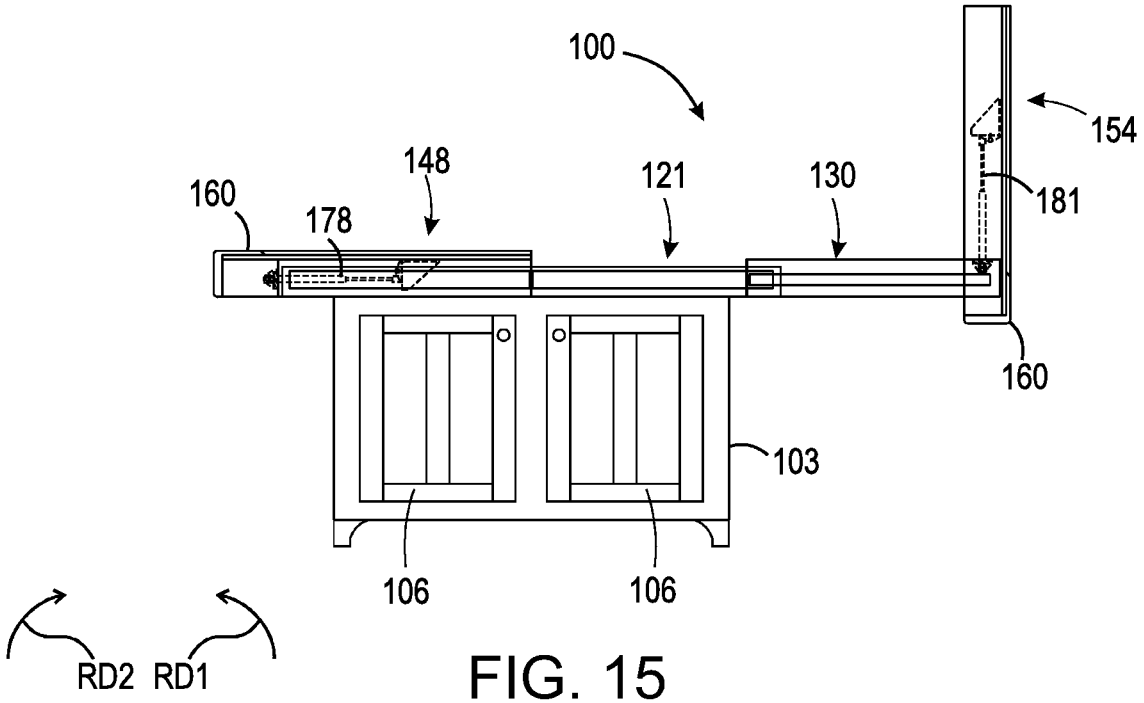
FIG. 15 is a side elevational view of the game table illustrated in half fully expanded state.

FIGS. 14 and 15 illustrate side cross-sectional views of the game table 100 in a half-partially expanded state and a half-fully expanded state, respectively. As can be seen, it should be appreciated third section 148 of third layer 145 can remain in a non-rotated state, i.e., rotated 0 degrees in first rotational direction RD1 about first hinge 172 with respect to first section 124 of second layer 121, while fourth section 154 of third layer 145 can be in a rotated state, e.g., rotated 90 degrees in second rotational direction RD2 about second hinge 175 with respect to second section 130 of second layer 121. In other words each section can pivot and/or translate independently of each other.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A game table comprising:

a base; and a top portion, the top portion comprising:

a first layer fixedly secured to the base;

a second layer arranged to at least partially encompass the first layer, wherein the second layer is slidingly engaged with the first layer; and, a third layer arranged to at least partially encompass and pivotably engage with the second layer;

wherein the first layer is operatively arranged to display a first plurality of assembled game pieces, the second layer is operatively arranged to display a first plurality of unassembled game pieces, and the third layer is operatively arranged to cover and protect the first and second layers.

2. The game table recited in claim 1, wherein the second layer comprising a first section and a second section.

3. The game table recited in claim 2, wherein the third layer comprises a third section and a fourth section.

4. The game table recited in claim 3, wherein the third section and the fourth section of the third layer are pivotably secured to the second layer.

5. The game table recited in claim 3, wherein the third section of the third layer is pivotably secured to the first section of the second layer via a first hinge.

6. The game table recited in claim 5, wherein the fourth section of the third layer is pivotably secured to the second section of the second layer via a second hinge.

7. The game table recited in claim 6, wherein the top portion further comprises a first rotational stop arranged between the first section of the second layer and the third section of the third layer, wherein the first rotational stop is arranged to prevent the third section from pivoting more than 90 degrees about the first hinge with respect to a surface of the second layer.

8. The game table recited in claim 6, wherein the top portion further comprises a second rotational stop arranged between the second section of the second layer and the fourth section of the third layer, wherein the second rotational stop is arranged to prevent the third section from pivoting more than 90 degrees about the second hinge with respect to a surface of the second layer.

9. The game table recited in claim 1, wherein the second layer further comprises a lip arranged about at least a portion of a perimeter of the second layer.

10. The game table recited in claim 1, wherein the third layer further comprises a border arranged about a perimeter of the third layer.

11. A game table comprising:

a base; and a top portion, the top portion comprising:

a first layer fixedly secured to the base;

a second layer comprising:

a first section and a second section, the first section and the second section arranged to at least partially encompass the first layer, wherein the first section and the second section are slidingly engaged with the first layer; and, a third layer comprising:

a third section arranged to at least partially encompass the first section of the second layer and pivotably engage with the first section of the second layer; and a fourth section arranged to at least partially encompass the second section of the second layer and pivotably engage with the second section of the second layer;

wherein the first layer is operatively arranged to display a first plurality of assembled game pieces, the second layer is operatively arranged to display a first plurality of unassembled game pieces, and the third layer is operatively arranged to cover and protect the first and second layers.

12. The game table recited in claim 11, wherein the third section of the third layer is pivotably secured to the first section of the second layer via a first hinge.

13. The game table recited in claim 11, wherein the fourth section of the third layer is pivotably secured to the second section of the second layer via a second hinge.

14. The game table recited in claim 11, wherein the top portion further comprises a first rotational stop arranged between the first section of the second layer and the third section of the third layer, wherein the first rotational stop is arranged to prevent the third section from pivoting more than 90 degrees about a first hinge with respect to the second layer.

15. The game table recited in claim 11, wherein the top portion further comprises a second rotational stop arranged between the second section of the second layer and the fourth section of the third layer, wherein the second rotational stop is arranged to prevent the third section from pivoting more than 90 degrees about a second hinge with respect to the second layer.

16. The game table recited in claim 11, wherein the second layer further comprises a lip arranged about at least a portion of a perimeter of the second layer.

17. The game table recited in claim 11, wherein the third layer further comprises a border arranged about a perimeter of the third layer.

* * * * *